US009584948B2

(12) United States Patent
Yeo et al.

(10) Patent No.: US 9,584,948 B2
(45) Date of Patent: Feb. 28, 2017

(54) METHOD AND APPARATUS FOR OPERATING MULTIPLE SPEAKERS USING POSITION INFORMATION

(71) Applicant: Samsung Electronics Co., Ltd., Suwon-si, Gyeonggi-do (KR)

(72) Inventors: Jaeyung Yeo, Seongnam-si (KR); Donghyun Yeom, Bucheon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 87 days.

(21) Appl. No.: 14/608,667

(22) Filed: Jan. 29, 2015

(65) Prior Publication Data

US 2015/0264504 A1 Sep. 17, 2015

(30) Foreign Application Priority Data

Mar. 12, 2014 (KR) ..... 10-2014-0028979

(51) Int. Cl.
*H04S 7/00* (2006.01)

(52) U.S. Cl.
CPC ..... *H04S 7/302* (2013.01)

(58) Field of Classification Search
CPC ..... H04S 7/302; H04S 7/303; H04S 7/301; H04S 7/308; H04R 27/00; H04R 3/12; H04R 2420/07; H04R 2227/005; H04R 2420/03
USPC ..... 381/300, 303, 119
See application file for complete search history.

(56) References Cited

U.S. PATENT DOCUMENTS

| | | | | |
|---|---|---|---|---|
| 8,351,612 | B2 | 1/2013 | Yoo et al. | |
| 9,232,335 | B2 * | 1/2016 | Carlsson | H04R 27/00 |
| 9,456,279 | B1 * | 9/2016 | Murdoch | H04R 3/12 |
| 9,465,450 | B2 * | 10/2016 | Cortenraad | G06F 3/0346 |
| 2004/0184617 | A1 | 9/2004 | Ono | |
| 2005/0152557 | A1 * | 7/2005 | Sasaki | H04S 7/302 381/58 |
| 2008/0063211 | A1 * | 3/2008 | Kusunoki | H04R 3/12 381/18 |
| 2008/0187144 | A1 | 8/2008 | Seo et al. | |
| 2008/0260131 | A1 | 10/2008 | Akesson | |
| 2010/0217413 | A1 | 8/2010 | Seiler | |
| 2012/0114151 | A1 | 5/2012 | Nguyen et al. | |
| 2012/0114152 | A1 | 5/2012 | Nguyen et al. | |
| 2012/0210223 | A1 | 8/2012 | Eppolito | |
| 2014/0328505 | A1 * | 11/2014 | Heinemann | H04S 7/303 381/303 |

(Continued)

FOREIGN PATENT DOCUMENTS

| | | | |
|---|---|---|---|
| EP | 1 796 429 | A1 | 6/2007 |
| JP | 2004-236192 | A | 8/2004 |
| KR | 10-0678929 | B1 | 1/2007 |

*Primary Examiner* — Vivian Chin
*Assistant Examiner* — Jason R Kurr
(74) *Attorney, Agent, or Firm* — Jefferson IP Law, LLP

(57) ABSTRACT

A method for detecting a plurality of available sound output devices when audio data is played back, and for detecting user position information and user direction information is provided. The method includes generating a plurality of pieces of sound information from the audio data, based on at least one of the detected user position information and the user direction information, and distributing each of the plurality of pieces of sound information to a corresponding sound output device from among the plurality of sound output devices.

18 Claims, 8 Drawing Sheets

(56) References Cited

U.S. PATENT DOCUMENTS

| | | | | |
|---|---|---|---|---|
| 2015/0256954 | A1* | 9/2015 | Carlsson | H04R 27/00 381/59 |
| 2015/0358756 | A1* | 12/2015 | Harma | H04S 7/302 381/17 |
| 2016/0029143 | A1* | 1/2016 | Johnson | H04R 5/02 381/303 |

* cited by examiner

METHOD AND APPARATUS FOR OPERATING MULTIPLE SPEAKERS USING POSITION INFORMATION

CROSS-REFERENCE TO RELATED APPLICATION(S)

This application claims the benefit under 35 U.S.C. §119 (a) of a Korean patent application filed on Mar. 12, 2014 in the Korean Intellectual Property Office and assigned Serial number 10-2014-0028979, the entire disclosure of which is hereby incorporated by reference.

TECHNICAL FIELD

The present disclosure relates to operating multiple speakers. More particularly, the present disclosure relates to a method and an apparatus for operating multiple channels by utilizing position information or direction information of a user.

BACKGROUND

It has become common for users to purchase and use one or more portable terminals, and the number of households in which each family member owns a portable terminal is increasing and thus, it is becoming universal for a household to use a plurality of terminals. In addition, a home-theater system formed of several speakers in a house that plays back 5.1 channel sound for advancing user's experience is also common consumer behavior.

There have been constant advancement in technologies that maximize realism while a user watches movies or listens to music through multiple channels. For example, a technology that outputs sounds using a source that are recorded for multiple channels, such as dolby digital or a DTS format, or processes, through a processor, a source provided based on an existing recording scheme, and divides the source for outputting through multiple channels, may be representatively used. The multi-channel operation requires multiple speakers disposed according to a corresponding digital processing scheme, and thus, the positions of the speakers are generally stationary.

Therefore, a need exists for a method and an apparatus for operating multiple channels by utilizing position information or direction information of a user.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide a user with a more optimal sound, compared to that provided by an existing multi-channel operation that operates channels of which positions and roles are fixed, by taking into consideration the fact that the position of a user is fluid with respect to the stationary speakers.

Another aspect of the present disclosure is to provide a method and an apparatus for operating multiple speakers by utilizing location information and direction information of a user.

In accordance with an aspect of the present disclosure, a method of operating multiple speakers is provided. The method includes detecting a plurality of available sound output devices when audio data is played back, detecting user position information and user direction information, generating a plurality of pieces of sound information from the audio data, based on at least one of the detected user position information and user direction information, and distributing each of the plurality of pieces of sound information to a corresponding sound output device from among the plurality of available sound output devices.

In accordance with an aspect of the present disclosure, an electronic device is provided. The electronic device includes a detecting unit configured to detect user position information and user direction information when audio data is played back, and a controller configured to generate a plurality of pieces of sound information from the audio data, based on at least one of the user position information and user direction information detected by the detecting unit, and to distribute each of the plurality of pieces of sound information to a corresponding sound output device from among a plurality of sound output devices.

According to an embodiment of the present disclosure, the position and direction of a user is detected and sound information is generated based on the detected information. Through the above, optimal sound may be provided to the user based on the position or direction of the user.

In addition, according to an embodiment of the present disclosure, an available sound output device may be detected as the position or direction of a user is changed, and an optimal sound may be provided to the user using the detected available sound output device.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other objects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
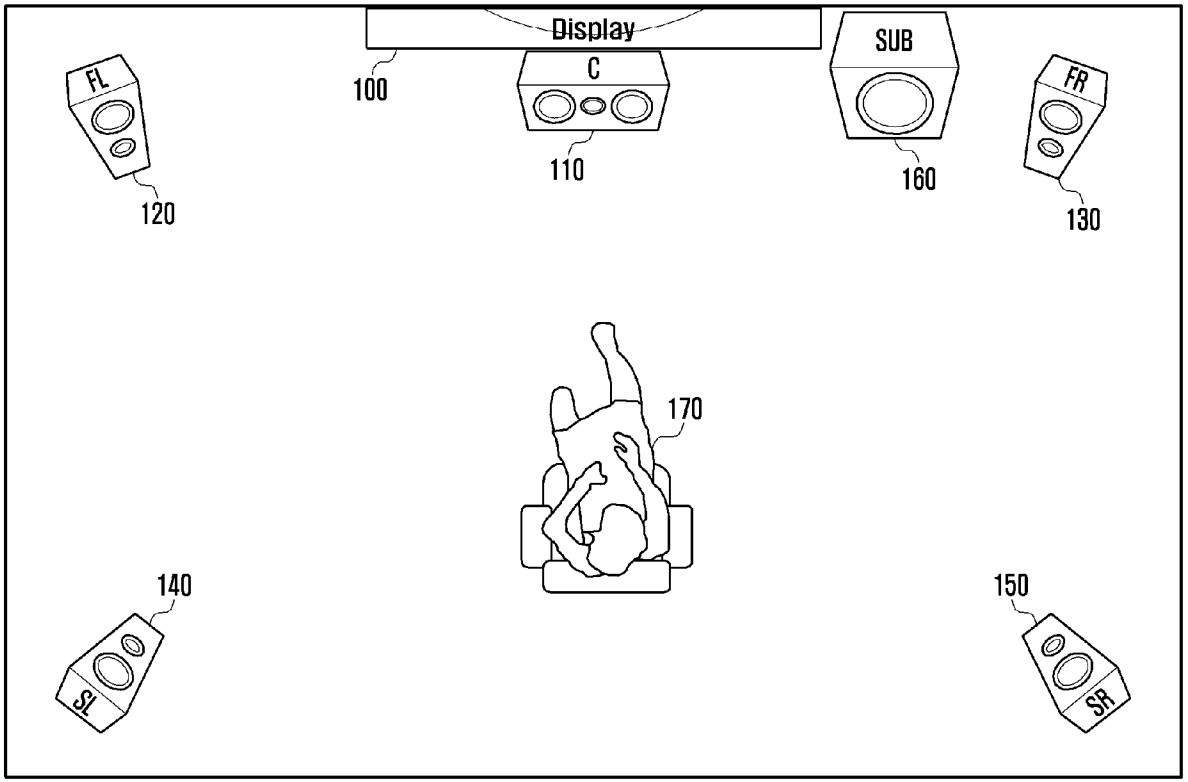
FIG. 1 is a diagram illustrating a 5.1 channel multi-speaker environment according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide.

As used herein, the expression "include" or "may include" refers to the existence of a corresponding function, operation, or element, and does not exclude one or more additional functions, operations, or elements. In addition, as used herein, the terms "include" and/or "have" should be construed to denote a certain feature, number, step, operation, element, component or a combination thereof, and should not be construed to exclude the existence or possible addition of one or more other features, numbers, steps, operations, elements, components, or combinations thereof.

In addition, as used here, the expression "or" includes any or all combinations of words enumerated together. For example, the expression "A or B" may include A, may include B, or may include both A and B.

In an embodiment of the present disclosure, the expressions "a first", "a second", "the first", "the second", and the like may modify various elements, but the corresponding elements are not limited by these expressions. For example, the above expressions do not limit the sequence and/or importance of the corresponding elements. The above expressions may be used merely for the purpose of distinguishing one element from the other elements. For example, a first user device and a second user device indicate different user devices although both of them are user devices. For example, a first element may be termed a second element, and similarly, a second element may be termed a first element without departing from the scope of the present disclosure.

The terms used in the present disclosure are only used to describe specific embodiments, and are not intended to limit the present disclosure.

Unless defined otherwise, all terms used herein, including technical and scientific terms, have the same meaning as those commonly understood by a person of ordinary skill in the art to which the present disclosure pertains. Such terms as those defined in a generally used dictionary are to be interpreted to have the meanings equal to the contextual meanings in the relevant field of the art, and are not to be interpreted to have ideal or excessively formal meanings unless clearly defined in the present disclosure.

An electronic device may be a device including a communication function. For example, the electronic device may include at least one of a smartphone, a tablet Personal Computer (PC), a mobile phone, a video phone, an electronic book (e-book) reader, a desktop PC, a laptop PC, a netbook computer, a Personal Digital Assistant (PDA), a Portable Multimedia Player (PMP), a Motion Pictures Expert Group (MPEG-1 or MPEG-2) Audio Layer 3 (MP3) player, a mobile medical appliance, a camera, and a wearable device (e.g., a Head-Mounted-Device (HMD), such as electronic glasses, electronic clothes, an electronic bracelet, an electronic necklace, an electronic appcessory, electronic tattoos, a smartwatch, and the like).

According to an embodiment of the present disclosure, an electronic device may be a smart home appliance with a communication function. The smart home appliances may include at least one of, for example, televisions (TVs), digital video disk (DVD) players, audio players, refrigerators, air conditioners, cleaners, ovens, microwaves, washing machines, air purifiers, set-top boxes, TV boxes (e.g., HomeSync™ of Samsung, Apple TV™, Google TV™, and the like), game consoles, electronic dictionaries, electronic keys, camcorders, electronic frames, and the like.

The electronic device may be a combination of one or more of the aforementioned various devices. In addition, the electronic device may be a flexible device. Further, it is obvious to those skilled in the art that the electronic device is not limited to the aforementioned devices.

Hereinafter, an electronic device according to various embodiments of the present disclosure will be described with reference to the accompanying drawings. In various embodiments, the term "user" may indicate a person using an electronic device or a device (e.g., an artificial intelligence electronic device) using an electronic device.

FIG. 1 is a diagram illustrating a 5.1 channel multi-speaker environment according to an embodiment of the present disclosure.

Referring to FIG. 1, based on a display 100 in the center, a front left (FL) speaker 120 is disposed to the left of a user 170, a front right (FR) speaker 130 is disposed to the right, and a center (C) speaker 110 is disposed between them. In addition, a surround left (SL) speaker 140 and a surround right (SR) speaker 150 are disposed on the back left side and the back right side of the user 170, respectively. The position of a woofer SUB 160 for low-pitched sound is not particularly determined, but generally, this may be disposed in the corner of the front side.

Figure 2A:
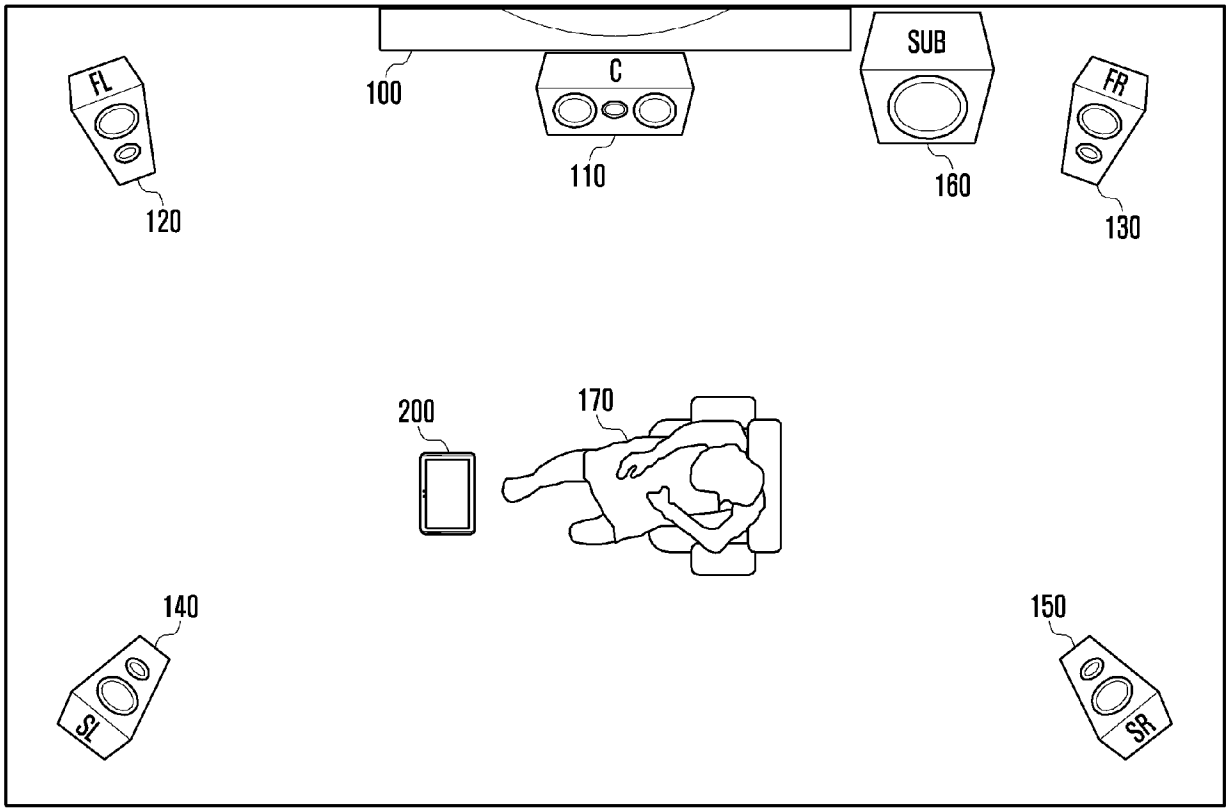
FIG. 2A is a diagram illustrating a 5.1 channel multi-speaker environment according to an embodiment of the present disclosure.
Figure 2B:
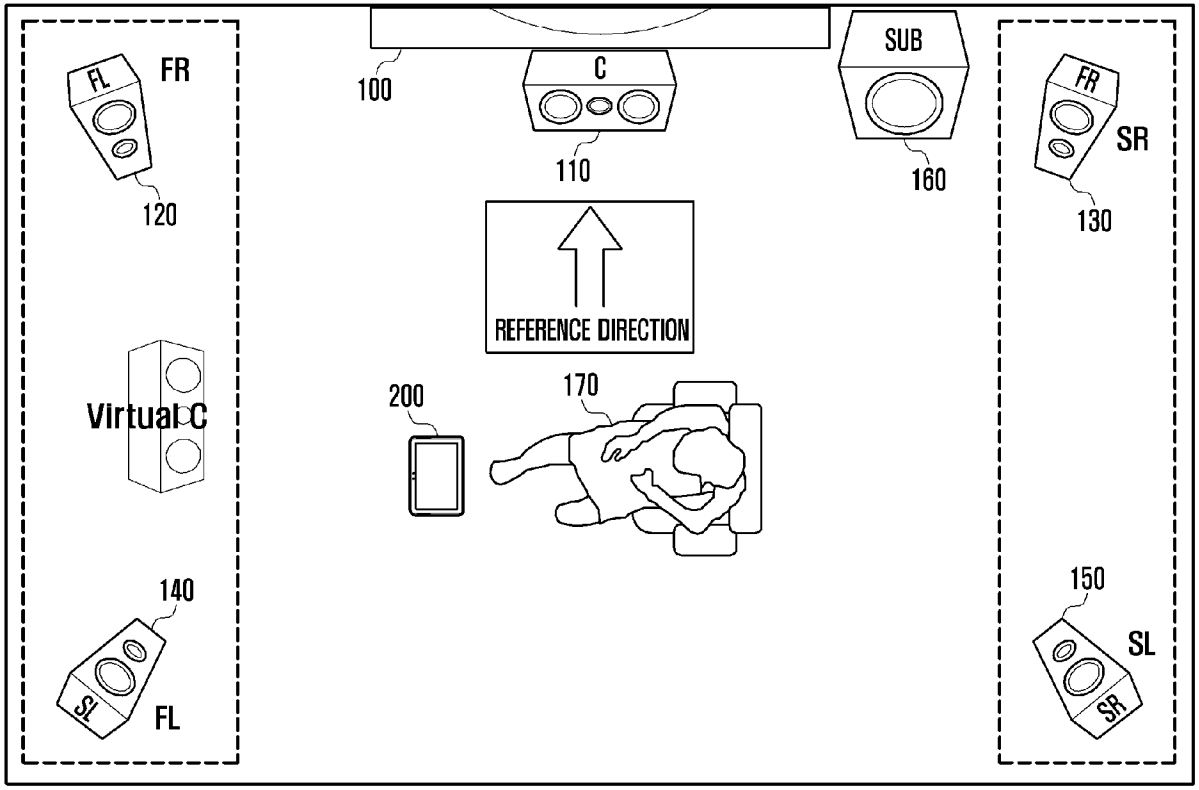
FIG. 2B is a diagram illustrating a 5.1 channel multi-speaker environment according to an embodiment of the present disclosure.

FIGS. 2A and 2B are diagrams illustrating a 5.1 channel multi-speaker environment according to an embodiment of the present disclosure.

Referring to FIG. 2A, a case in which the user 170 changes direction and views a display 200 in the left side may be considered. The display 200 may be a wide-screen device, such as a TV, and may be a small device, such as a tablet PC or the like. When a sound output from each speaker is fixed, the user 170 may hear sounds distributed to the FL speaker 120 and the SL speaker 140 in the front side of the user 170 and thus, the sounds may disturb the user while watching movie. It is also true when the user listens to music, in addition to watching movie. The user 170 have an experience as if the user views a side of a stage at a concert as opposed to viewing the stage since staging is formed on the right side of the user 170. Therefore, there is a need for redistribution of the output of sound through the speakers.

Referring to FIG. 2B, when the user 170 plays back content through the electronic device 200, the electronic device 200 may detect available sound output devices and then, detect the direction of the user. The electronic device 200 may generate sound information to be distributed to the available sound output devices based on the detected direction of the user. The present embodiment may change an output of a speaker based on the direction the user is detected to be facing (to the left with respect to the reference direction). For example, the user 170 faces to the left and thus, a speaker that used to play the role of the FL speaker 120 in the reference direction may play the role of a FR speaker. Since the user 170 changes the direction he/she is facing so as to face towards the left side, a speaker that played the role of the SL speaker 140 in the reference direction may play the role of FL speaker. In the same manner, the FR speaker in the reference direction plays the role of an SR speaker and the SR speaker in the reference direction plays the role of an SL speaker.

When the user 170 faces towards the left with respect to the reference direction, the C speaker 110 does not exist, and two speakers 120 and 140 disposed on the front side of the user 170 may provide a sound effect as if a virtual C speaker exists. In other words, the speaker 120 outputs a FR sound and partially outputs a sound of the C speaker 110, and the speaker 140 outputs a FL sound and partially outputs the sound of the C speaker 110. The reason why the speakers operate as described above is that the C speaker 110 mainly used for people's voices and it is awkward when the people's voices come from the back instead of the front. According to another embodiment of the present disclosure, the C speaker 110 may operate in the original position. The woofer SUB 160 may be in charge of a low-pitched sound in the existing position, unless otherwise specified, and another speaker may play a role of the woofer 160 based on some settings. According to another embodiment of the present disclosure, the C speaker 110 may not be operated. In this instance, a user may hear a sound track that is converted from 5.1 channel to 4.1 channel. In addition, according to user's setting or the number of available sound output devices, the operation may be available with a larger or smaller number of channels than before.

According to an embodiment of the present disclosure, the user 170 faces the back side, which is opposite to the reference direction, and plays back content through the electronic device 200. In this instance, the electronic device 200 detects the direction of the user, and may generate a plurality of pieces of sound information based on the detected direction. Each of the plurality of pieces of sound information may include at least one of volume information, the number of channels, and channel distribution information. The plurality of pieces of generated sound information is distributed to a plurality of corresponding sound output devices, and the sound output devices output sounds. For example, the SL speaker 140 in the reference direction plays the role of a FR speaker, and the SR speaker 150 in the reference direction plays the role of a FL speaker. In this manner, the FL speaker 120 in the reference direction plays the role of a back right speaker, and the FR speaker 130 in the reference direction plays the role of a back left speaker. In addition, after the change of the direction, the speakers 140 and 150 which respectively play roles of a FL speaker and a FR speaker may divide up and output the sound of the C speaker.

According to an embodiment of the present disclosure, the user 170 faces towards the right with respect to the reference direction, and plays back content through the electronic device 200. In this instance, the electronic device 200 detects the direction of the user, and may generate a plurality of pieces of sound information based on the detected direction. The plurality of pieces of generated sound information is distributed to a plurality of corresponding sound output devices, and the sound output devices output sounds. For example, the SL speaker 140 in the reference direction plays the role of a back right speaker, and the SR speaker 150 in the reference direction plays the role of a FR speaker. In this manner, the FL speaker 120 in the reference direction plays the role of a back left speaker, and the FR speaker 130 in the reference direction plays the role of a FL speaker. In addition, after the change of the direction, the speakers 130 and 150 which respectively play roles of a FL speaker and a FR speaker may divide up and output the sound of the C speaker.

According to an embodiment of the present disclosure, the user 170 faces towards the front which is the same as reference direction, and plays back a content through the electronic device 200. In this instance, the direction is normal and corresponds to a direction that is set as a default, unless different user position information and user direction information are input. For example, the C speaker 110, the FL speaker 120, the FR speaker 130, the SL speaker 140, and the SR speaker 150, and the woofer SUB 160 are assigned with basic sound information, and output sounds, respectively. The basic sound information may be provided as a source, such as dolby digital or DTS-format, or may be provided as a source that is recorded for multiple channels or recorded through an existing recording scheme.

Figure 3:
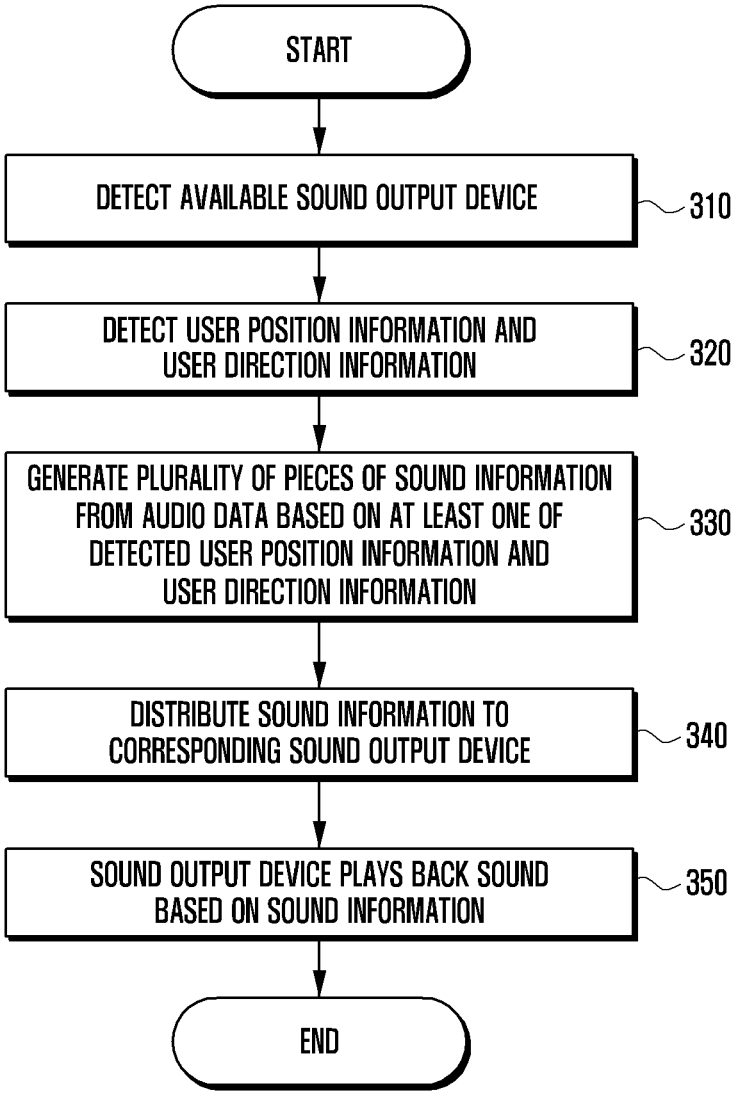
FIG. 3 is a flowchart illustrating an operation of generating sound information and outputting a sound according to an embodiment of the present disclosure.

FIG. 3 is a flowchart illustrating an operation of generating sound information in and outputting a sound according to an embodiment of the present disclosure.

Referring to FIG. 3, in operation 310, the electronic device 200 detects available sound output devices. The operation may be executed only once, or may be repeatedly executed. The electronic device may recognize position information of sound output devices through a user interface or a wired/wireless device, and the position information may be absolute position information or relative position information of devices or sound sources. As an example, a method of wirelessly detecting sound output devices may include a method in which an electronic device detects sound output devices using the Zigbee protocol since the sound output devices are designed to conform to the Zigbee protocol format (Institute of Electrical and Electronics Engineers (IEEE) 802.15.4).

Subsequently, in operation 320, the electronic device 200 may detect the position and the direction of a user. A method of detecting the position and the direction of a user may include a method of using a sensor to detect the position and the direction of a user, a method of using position information of an electronic device where content is played back, so as to indirectly detect the position and the direction of a user, and a method of simultaneously using the above described methods. According to another embodiment of the present disclosure, the position and the direction of a user may be detected based on available sound output devices. A method of detecting the position and the direction of a user based on available sound output devices may include a method of installing a microphone in a device that plays back content, generating a reference sound of a certain band through a sound output device, monitoring the reference sound through the microphone, so as to detect the position and the direction of a user, and a method of attaching a sensor to each sound output device, and recognizing locations of the sensors, so as to detect the position and the direction of a user, and a method of using both the methods so as to detect the position and the direction of a user.

In operation 330, the electronic device generates a plurality of pieces of sound information from audio data, based on at least one of the detected user position information and user direction information. The audio data refers to digital data, and the sound information refers to a sound signal generated for at least two speakers.

According to an embodiment of the present disclosure, a method of generating a plurality of pieces of sound information from audio data based on at least one of position information and direction information may use a revising matrix. For example, when a user faces the reference direction and plays back a content in the 5.1 channel environment of FIG. 2B, the electronic device may receive detected direction information (reference direction) and may set sound information through a revising matrix as shown below.

$$\begin{pmatrix} SI1 \\ SI2 \\ SI3 \\ SI4 \\ SI5 \\ SI6 \end{pmatrix} = \begin{pmatrix} 1 & 0 & 0 & 0 & 0 & 0 \\ 0 & 1 & 0 & 0 & 0 & 0 \\ 0 & 0 & 1 & 0 & 0 & 0 \\ 0 & 0 & 0 & 1 & 0 & 0 \\ 0 & 0 & 0 & 0 & 1 & 0 \\ 0 & 0 & 0 & 0 & 0 & 1 \end{pmatrix} * \begin{pmatrix} AD1 \\ AD2 \\ AD3 \\ AD4 \\ AD5 \\ AD6 \end{pmatrix}$$

According to the revising matrix, first Sound Information (SI) is set as first Audio Data (AD), second SI is set as second AD, third SI is set as third AD, fourth SI is set as fourth AD, fifth SI is set as fifth AD, and sixth SI is set as sixth AD, so that a plurality of pieces of sound information may be generated. The first AD has a sound effect of the C speaker 110, the second AD has a sound effect of the FL speaker 120, the third AD has a sound effect of the FR speaker 130, the fourth AD has a sound effect of the SL speaker 140, the fifth AD has a sound effect of SR speaker 150, and the sixth AD has a sound effect of the woofer 160, respectively. In addition, the first SI corresponds to the C speaker 110, the second SI corresponds to the speaker 120, the third SI corresponds to the speaker 130, the fourth SI corresponds to the speaker 140, the fifth SI corresponds to the speaker 150, and the sixth SI corresponds to the speaker 160.

According to another embodiment of the present disclosure, when a user faces towards the left with respect to the reference direction and plays back content in the 5.1 channel environment of FIG. 2B, the electronic device may receive detected direction information (the left with respect to the reference direction) and may set sound information through a revising matrix as shown below.

$$\begin{pmatrix} SI1 \\ SI2 \\ SI3 \\ SI4 \\ SI5 \\ SI6 \end{pmatrix} = \begin{pmatrix} 0 & 0 & 0 & 0 & 0 & 0 \\ n & 0 & 1 & 0 & 0 & 0 \\ 0 & 0 & 0 & 0 & 1 & 0 \\ n & 1 & 0 & 0 & 0 & 0 \\ 0 & 0 & 0 & 1 & 0 & 0 \\ 0 & 0 & 0 & 0 & 0 & 1 \end{pmatrix} * \begin{pmatrix} AD1 \\ AD2 \\ AD3 \\ AD4 \\ AD5 \\ AD6 \end{pmatrix}$$

The first SI is information corresponding to the C speaker 110, and all numbers are set to zero. The second SI is information corresponding to the speaker 120, and is set as first AD that provides a sound effect of the C speaker and third AD that provides a FR sound effect. In this instance, the C speaker 110 does not exist, and thus, the second SI may be set by partially adjusting the first AD. The third SI is information corresponding to the speaker 130, and is set as the fifth AD that provides a back right sound effect. The fourth SI is information corresponding to the speaker 140, and is set as first AD that provides a sound effect of the C speaker and second AD that provides a FL sound effect. The fifth SI is information corresponding to the speaker 150, and is set as fourth AD that provides a back left sound effect. The sixth SI is information corresponding to the speaker 160, and is set as sixth AD that provides a low-pitched sound effect. The revising matrix may be expressed by a general expression, as shown below.

$$\begin{pmatrix} SI1 \\ SI2 \\ SI3 \\ \dots \\ SI_n \end{pmatrix} = \begin{pmatrix} K_{11} & K_{12} & K_{13} & \dots & K_{1n} \\ K_{21} & K_{22} & K_{23} & \dots & K_{2n} \\ K_{31} & K_{32} & K_{33} & \dots & K_{3n} \\ \dots & \dots & \dots & \dots & \dots \\ K_{n1} & K_{n2} & K_{n3} & \dots & K_{nn} \end{pmatrix} * \begin{pmatrix} AD1 \\ AD2 \\ AD3 \\ \dots \\ AD_n \end{pmatrix}$$

In the revising matrix, SI refers to sound information, and corresponds to each sound output device. AD refers to audio data, and n denotes the number of channels. K refers to each component of the revising matrix, and through which audio data is adjusted and sound information may be generated. According to an embodiment of the present disclosure, the number of channels of the sound information may be variously changed from two channels to multiple channels, based on n of the revising matrix, and volume information and channel distribution information may be converted based on K.

According to another embodiment of the present disclosure, audio data may be digital data divided for various channels, or may be data that is not distinguished based on a channel. As described above, audio data that is not divided based on a channel, may be divided through sound processing, so as to be output through multiple channels. An end result of a sound that is converted for multiple channels may be provided in various forms, such as 5CH, 4CH 5.1CH, 7.1CH, and the like, based on processing. In addition, in a case of a multi-channel digital sound source that is divided based on a channel, conversion for increasing or decreasing the number of channels to be appropriate for resources of a system may be applicable. In addition, when a sound source that includes a plurality of multi-channel formats (for example, DTS-HDMA7.1 DTS 5CH, DD 5.1CH, DD4.1CH, STREO 2CH, and the like are included in a single video), sound processing may increase or decrease the number of channels to be appropriate for resources of a system, or simply switch multi-channel formats. In operation 340, the electronic device 200 distributes a plurality of pieces of generated sound information corresponding sound output devices. For example, when a user faces the reference direction and plays back content in the 5.1 channel environment, the electronic device generates first SI through sixth SI, and matches them to corresponding speakers, respectively. For example, the electronic device distributes the first SI to the C speaker 110. The electronic device distributes the second SI to FL speaker 120, and distributes the third SI to FR speaker 130. In addition, the electronic device distributes the fourth SI to SL speaker 140, distributes the fifth SI to SR speaker 150, and distributes the sixth SI to the woofer SUB 160.

In operation 350, each sound output device outputs a sound based on the distributed sound information. A sound output device may include at least one of a smart phone, a speaker, an audio, a DVD player, a PDA, a PMP, and an MP3 player, and may include all electronic devices that provide a similar effect.

Figure 4:
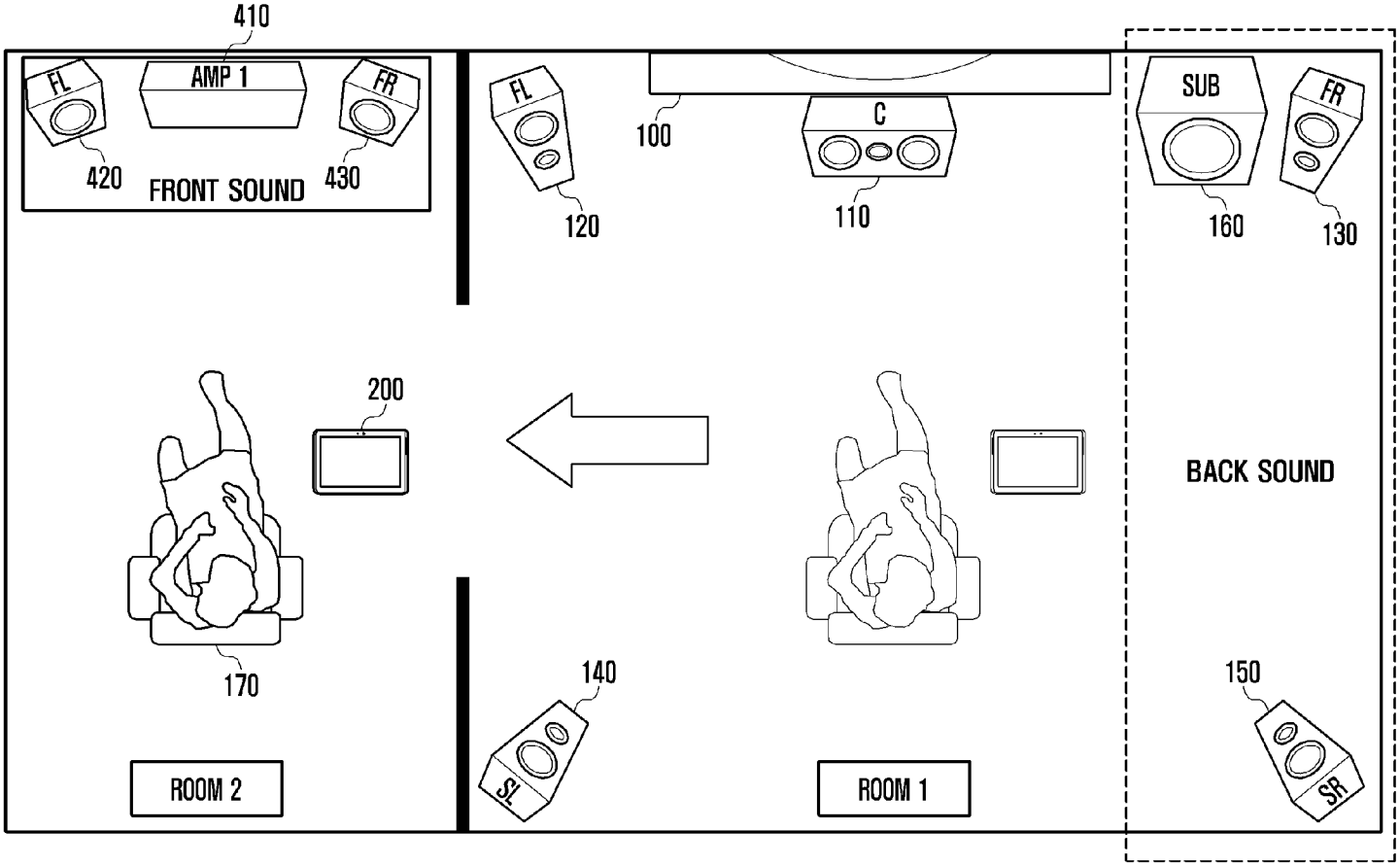
FIG. 4 is a diagram illustrating an environment that uses new sound output devices, based on a change in a position of a user, according to an embodiment of the present disclosure.

FIG. 4 is a diagram illustrating an environment that uses new sound output devices, based on a change in a position of a user, according to an embodiment of the present disclosure.

Referring to FIG. 4, the user 170 changes his/her position from ROOM1 to ROOM2 while content is played back in ROOM1, and then plays back the content in ROOM2. According to an embodiment of the present disclosure, when the user plays back the content in ROOM2, the electronic device 200 detects new sound output devices. In addition, the electronic device 200 recognizes the detected new sound output devices, detects the position and the direction of the user 170, and provides an optimal sound effect to the user 170 based on the same. More particularly, the electronic device 200 compares sound output devices used in ROOM1 with the detected new sound output devices, and when it is determined that the detected new sound output devices provide a better sound effect to the user 170, the electronic device 200 may stop using the existing sound output devices and may begin to use the detected new sound output devices. For example, when the position of the user 170 is changed from ROOM1 to ROOM2, the electronic device 200 stops using the speakers 110 to 160 that have been used in ROOM1 and begins to use speakers 410, 420, and 430 of ROOM2. In this instance, a sound environment of the user is changed from 5.1 channel environment to 3 channel environment. The sound of the C speaker 110 may be output from the AMP1 410, and the speakers 420 and 430 of ROOM2 may be used for the FL speaker 120 and FR speaker 130, and thus, the FRONT SOUND effect may be provided. In addition, the BACK SOUND effect may or may not be used. When the BACK SOUND effect is used, the FR speaker 130, the SR speaker 150, and the woofer SUB 160 may provide the BACK SOUND effect as shown in FIG. 4. As a matter of course, the FL speaker 120, the SL speaker 140, and the C speaker 110 may provide the back sound effect.

According to another embodiment of the present disclosure, when the user 170 faces to the right with respect to the reference direction in ROOM2 and plays back a content through the electronic device 200, the FR speaker 130, the SR speaker 150, the woofer SUB 160 in ROOM1 may provide the FRONT SOUND effect, and the speakers 410, 420, and 430 in ROOM2 may provide the BACK SOUND effect.

According to another embodiment of the present disclosure, when the position of the user 170 changes, before automatically using new sound output devices detected in the changed environment, the electronic device 200 may ask the user 170 whether to use the detected new sound output devices. When the user 170 does not use the detected new sound output devices, the electronic device 200 continuously uses the existing sound output devices even when the position of the user 170 changes.

Figure 5:
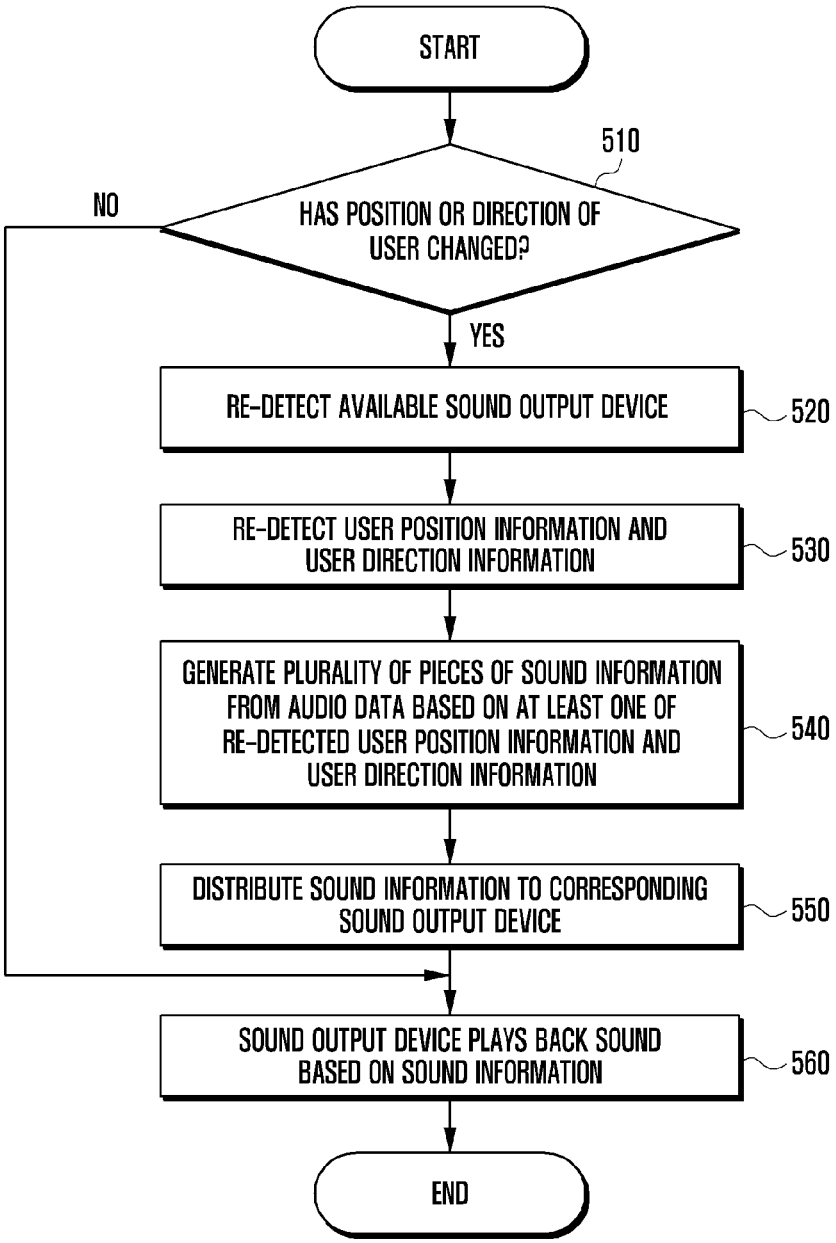
FIG. 5 is a flowchart illustrating an operation of generating sound information and outputting a sound according to an embodiment of the present disclosure.

FIG. 5 is a flowchart illustrating an operation of generating sound information and outputting a sound according to an embodiment of the present disclosure.

Referring to FIG. 5, in operation 510, when the user 170 moves to a new environment, the electronic device 200 determines whether the position or the direction of the user has changed. When the position or the direction of the user has changed, the electronic device proceeds with operation 520, so as to re-detect available sound output devices. When the position or the direction of the user has not changed, the electronic device proceeds with operation 560 so that a plurality of sound output devices outputs sounds based on existing sound information.

The electronic device returns again to operation 520, and when the position or the direction of the user changes, the electronic device re-detects available sound output devices in a new environment. In this instance, the electronic device may recognize position information of the sound output devices through a wired/wireless device, and the position information may be absolute position information or relative position information of devices or sound sources. According to an embodiment of the present disclosure, a method of wirelessly detecting sound output devices may include a method in which an electronic device detects sound output devices using the Zigbee protocol since the sound output devices are designed to conform to the Zigbee protocol format (IEEE 802.15.4).

Subsequently, in operation 530, the electronic device may re-detect the position and the direction of the user. Examples of a method of detecting the position and the direction of a user may include a method of using a sensor to detect the position and the direction of a user, a method of using position information of an electronic device where content is played back, so as to indirectly detect the position and the direction of a user, and a method of simultaneously using the above described methods. According to another embodiment of the present disclosure, the position and the direction of a user may be detected based on available sound output devices. A method of detecting the position and the direction of a user based on available sound output devices may include a method of installing a microphone in a device that plays back content, generating a reference sound of a certain band through a sound output device, monitoring the reference sound through the microphone, so as to detect the position and the direction of a user, and a method of attaching a sensor to each sound output device, and recognizing locations of the sensors, so as to detect the position and the direction of a user, and a method of using both the methods so as to detect the position and the direction of a user.

In operation 540, the electronic device generates a plurality of pieces of sound information from audio data, based on at least one of the re-detected user position information and user direction information. According to an embodiment of the present disclosure, sound information may be generated based on at least one of the user position information and user direction information, using a revising matrix. Referring to FIG. 4, when the user moves from ROOM1 to ROOM2, the electronic device 200 re-detects three new speakers 410, 420, and 430, and re-detects the position and the direction of the user. In this instance, it is detected that the user faces the reference direction and thus, the electronic device may provide the FRONT SOUND effect through the AMP1 410, the speaker 420, and the speaker 430. Accordingly, the electronic device 200 may generate sound information using the following revising matrix so that the AMP1 410 provides an effect of a C speaker, the speaker 420 provides a FL speaker effect, and the speaker 430 provides a FR speaker effect.

$$\begin{pmatrix} SI1 \\ SI2 \\ SI3 \\ SI4 \\ SI5 \\ SI6 \\ SI7 \\ SI8 \\ SI9 \end{pmatrix} = \begin{pmatrix} 0 & 0 & 0 & 0 & 0 & 0 \\ 0 & 0 & 0 & 0 & 0 & 0 \\ 0 & 0 & 0 & 0 & 1 & 0 \\ 0 & 0 & 0 & 0 & 0 & 0 \\ 0 & 0 & 0 & 1 & 0 & 0 \\ 0 & 0 & 0 & 0 & 0 & 1 \\ 1 & 0 & 0 & 0 & 0 & 0 \\ 0 & 1 & 0 & 0 & 0 & 0 \\ 0 & 0 & 1 & 0 & 0 & 0 \end{pmatrix} * \begin{pmatrix} AD1 \\ AD2 \\ AD3 \\ AD4 \\ AD5 \\ AD6 \end{pmatrix}$$

According to the revising matrix, the first SI, the second SI, and the forth SI correspond to the C speaker 110, the speaker 120, and the speaker 140, respectively, and in this instance, they are not operated as the position of the user is changed. The third SI is information corresponding to the speaker 130, and is set as the fifth AD that provides a back right sound effect. The fifth SI is information corresponding to the speaker 150, and is set as the fourth AD that provides a back left sound effect. The sixth SI is information corresponding to the speaker 160, and is set as the sixth AD that provides a low-pitched sound effect. In addition, the seventh SI is information corresponding to the detected new AMP1 410, and is set as the first AD that provides a C speaker sound effect. The eighth SI is information corresponding to the detected new speaker 420, and is set as the second AD that provides a FL sound effect. The ninth SI is information corresponding to the detected new speaker 430, and is set as the third AD that provides a FR sound effect. The electronic device 200 generates the first SI through the ninth SI, as described above.

In operation 550, the electronic device may distribute the plurality of pieces of generated sound information to corresponding sound output devices, respectively. For example, when the user plays back content after the position of the use changes from the 5.1 channel environment (ROOM1) to 3 channel speaker environment (ROOM2) in FIG. 4, the electronic device generates sound information corresponding to each speaker and distributes sound information that provides a C speaker effect to the AMP1 410 of ROOM2. In addition, the electronic device distributes sound information that provides a FL effect to the speaker 420 of ROOM2, and distributes sound information that provides a FR effect to the speaker 430 of ROOM2. The electronic device may distribute sound information that may provide the BACK SOUND effect, to speakers 130, 150, and 160 of ROOM1, respectively.

In operation 560, each sound output device outputs a sound based on the distributed sound information.

Figure 6:
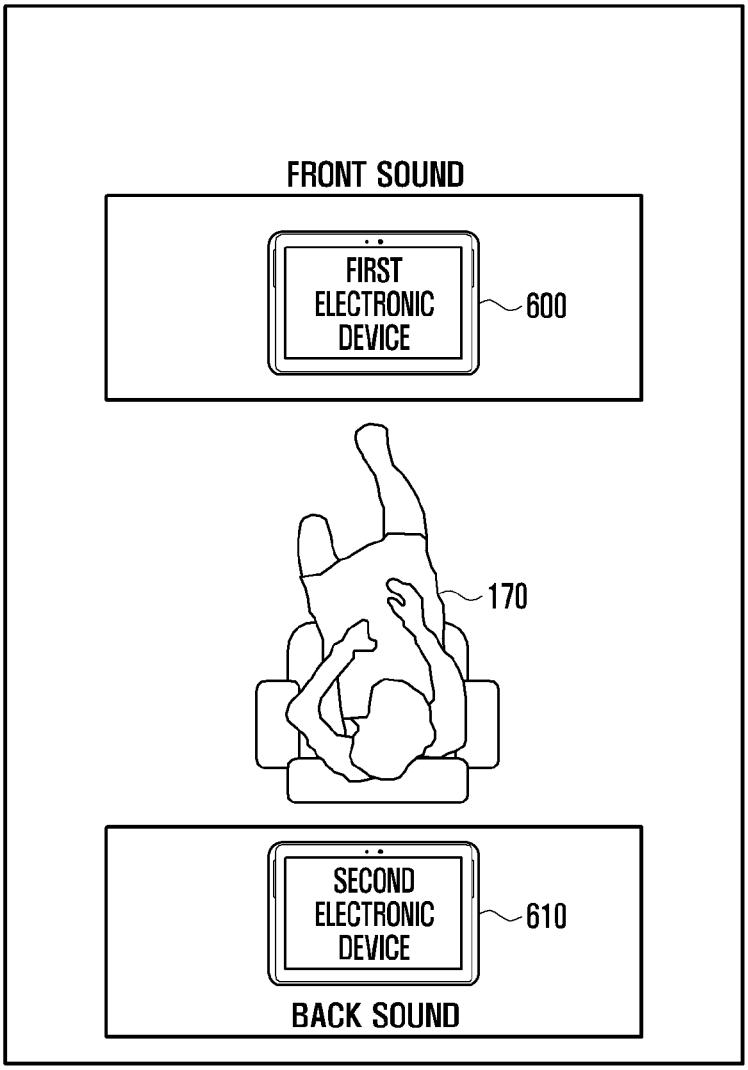
FIG. 6 is a diagram illustrating a generation of sound information using two electronic devices and outputting a sound according to an embodiment of the present disclosure.

FIG. 6 is a diagram illustrating a generation of sound information using two electronic devices and outputting a sound according to an embodiment of the present disclosure.

FIG. 6 corresponds to an example that utilizes the present disclosure through a plurality of electronic devices, instead of a system where an AMP and speaker resources are fixed.

Referring to FIG. 6, when a first electronic device 600 and a second electronic device 610 exist, the first electronic device 600 may detect the available second electronic device 610. In addition, the first electronic device 600 may detect the position and the direction of the user 170 based on relative position information of the first and second electronic devices 600 and 610 and the position information of the first electronic device 600 that plays back content. The first electronic device 600 generates first sound information that provides the CENTER SOUND effect and the FRONT SOUND effect and second sound information that provides the BACK SOUND effect, based on the detected position and direction of the user 170. The first electronic device 600 may output a sound based on the first sound information, and transmit the second sound information to the second electronic device 610. The second electronic device 610 receives the second sound information, and outputs a sound based on the same. For example, the speaker of the first electronic device 600 provides the CENTER SOUND effect and the FRONT SOUND effect, and the speaker of the second electronic device 610 provides the BACK SOUND effect and thus, the user may be provided with a realistic sound effect.

Figure 7:
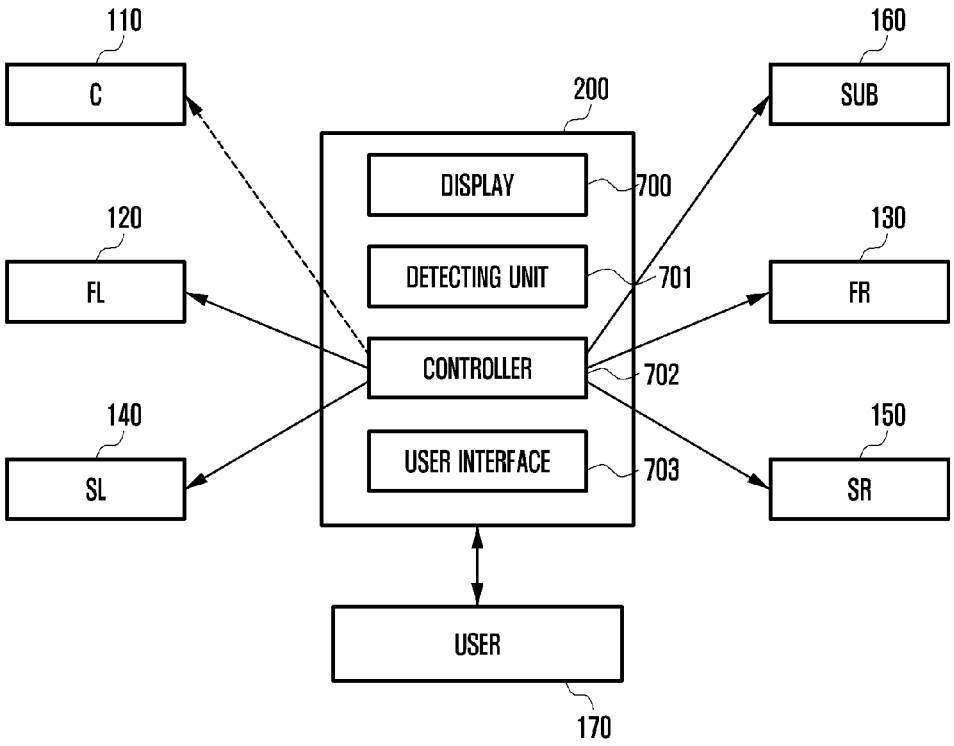
FIG. 7 is a block diagram illustrating an electronic device according to an embodiment of the present disclosure.

FIG. 7 is a block diagram illustrating an electronic device according to an embodiment of the present disclosure.

Referring to FIG. 7, the electronic device 200 may include a display 700 that shows a status of a channel, a detecting unit 701 that detects available sound output devices and detects user position information and user direction information, a controller 702 that receives a command from the detecting unit 701 and generates sound information, and controls each component of a sound output device, a user interface 703, and sound output devices 110 to 160. The electronic device 200 of FIG. 7 includes a 5.1 channel sound output device and thus, the controller 702 generates sound information for the C speaker 110, the FL speaker 120, the FR speaker 130, the SL speaker 140, the SR speaker 150, and the woofer SUB 160. The generated sound information may be wiredly or wirelessly distributed by the controller 702 to corresponding speakers 110 to 160, respectively. The controller 702 controls each component of the sound output devices, and may receive a control command through the user interface 703 and generate a control signal. In the present disclosure, the controller 702 may receive user position information and user direction information from the user interface 703, or may receive user position information and user direction information from the detecting unit. In addition, based on the received user position information or the user direction information, the controller 702 may generate sound information so as to output sounds based on the position of the user.

The user interface 703 may transfer, to the controller 702, a control command input by the user to control the sound output devices. The user interface 703 may be embodied as a remote control device, an On Screen Display (OSD) using a touch screen or the like, or a control button that is attached to the sound output devices. The user may use the user interface 703 for turning the volume up or down, or for an equalizer function, or for executing a command, such as recording, playback, or the like.

The display 700 may display a corresponding state when the user controls sound output devices. The display may be a monitor or a screen, or may be a dot matrix formed of Light Emitting Diodes (LEDs). When the user interface 703 embodied as the OSD is used, a separate display may not be required.

In addition, the present disclosure may be applied to various sources, such as image information, content information, or the like, in addition to sound information, and may be applied to various resources, such as an image playback device, a media output device, and the like, in addition to a sound output device.

In the above embodiments, all operations may be optionally performed or may be omitted. Further, operations in each embodiment do not have to be sequentially performed and may be transposed.

Certain aspects of the present disclosure can also be embodied as computer readable code on a non-transitory computer readable recording medium. A non-transitory computer readable recording medium is any data storage device that can store data which can be thereafter read by a computer system. Examples of the non-transitory computer readable recording medium include Read-Only Memory (ROM), Random-Access Memory (RAM), Compact Disc-ROMs (CD-ROMs), magnetic tapes, floppy disks, and optical data storage devices. The non-transitory computer readable recording medium can also be distributed over network coupled computer systems so that the computer readable code is stored and executed in a distributed fashion. In addition, functional programs, code, and code segments for accomplishing the present disclosure can be easily construed by programmers skilled in the art to which the present disclosure pertains.

At this point it should be noted that the various embodiments of the present disclosure as described above typically involve the processing of input data and the generation of output data to some extent. This input data processing and output data generation may be implemented in hardware or software in combination with hardware. For example, specific electronic components may be employed in a mobile device or similar or related circuitry for implementing the functions associated with the various embodiments of the present disclosure as described above. Alternatively, one or more processors operating in accordance with stored instructions may implement the functions associated with the various embodiments of the present disclosure as described above. If such is the case, it is within the scope of the present disclosure that such instructions may be stored on one or more non-transitory processor readable mediums. Examples of the processor readable mediums include a ROM, a RAM, CD-ROMs, magnetic tapes, floppy disks, and optical data storage devices. The processor readable mediums can also be distributed over network coupled computer systems so that the instructions are stored and executed in a distributed fashion. In addition, functional computer programs, instructions, and instruction segments for accomplishing the present disclosure can be easily construed by programmers skilled in the art to which the present disclosure pertains.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A method of operating multiple speakers, the method comprising:

detecting a plurality of available sound output devices when audio data is played back;

detecting user position information and user direction information of a user;

generating a plurality of pieces of sound information from the audio data, based on at least one of the detected user position information and the user direction information; and distributing each of the plurality of pieces of sound information to a corresponding sound output device from among the plurality of available sound output devices;

recognizing a change in at least one of a position and a direction of the user;

when a change in at least one of the position and the direction of the user is recognized, re-detecting at least one of the user position information and the user direction information; and regenerating a plurality of pieces of sound information from the audio data, based on the at least one of re-detected user position information and the user direction information, wherein the regenerating of the plurality of pieces of sound information comprises converting a number of sound output channels from m to n ($m>0$, $n>0$, $m\neq n$).

2. The method of claim 1, wherein each sound output device outputs a sound based on the distributed sound information.

3. The method of claim 1, wherein the detecting of the user position information and the user direction information detects a relative position and direction of a user with respect to the plurality of available sound output devices.

4. The method of claim 1, wherein the detecting of the user position information and the user direction information comprises:

outputting a reference sound of a certain band through the plurality of available sound output devices;

monitoring the output reference sound using a microphone; and detecting a position and a direction of the user based on a result of monitoring.

5. The method of claim 1, wherein each of the plurality of pieces of sound information comprises at least one piece of information from among volume information, a number of channels, and channel distribution information.

6. The method of claim 5, wherein the number of channels of the plurality of pieces of sound information comprises n channels ($n>0$).

7. The method of claim 1, further comprising:

distributing each of the plurality of pieces of regenerated sound information to a corresponding sound output device from among the plurality of available sound output devices.

8. The method of claim 1, further comprising:

re-detecting a plurality of available sound output devices when a change in at least one of the position and the direction of the user is recognized.

9. The method of claim 8, wherein the re-detecting of the at least one of the user position information and the user direction information further comprises:

re-detecting at least one of the user position information and the user direction information, based on the plurality of re-detected sound output devices.

10. An electronic device comprising:

a detector configured to detect user position information and user direction information of a user when audio data is played back; and a processor configured to:

generate a plurality of pieces of sound information from the audio data, based on at least one of the user position information and the user direction information detected by the detector, and distribute each of the plurality of pieces of sound information to a corresponding sound output device from among a plurality of sound output devices, execute a control so as to recognize a change in at least one of a position and a direction of the user, re-detect at least one of the user position information and the user direction information of the user when a change in at least one of the position and the direction of the user is recognized, execute a control so as to regenerate a plurality of pieces of sound information from the audio data, based on the re-detected user position information and the user direction information, and convert a number of sound output channels from m to n ($m>0$, $n>0$, $m\neq n$), when the plurality of pieces of sound information is regenerated.

11. The electronic device of claim 10, wherein the plurality of sound output devices is further configured to output sounds based on the distributed sound information.

12. The electronic device of claim 11, wherein the processor is further configured to detect available sound output devices from among the plurality of sound output devices when the audio data is played back.

13. The electronic device of claim 12, wherein the detector is further configured to detect a relative position and direction of the user with respect to the plurality of sound output devices.

14. The electronic device of claim 11, wherein, when a reference sound of a certain band is output from the plurality of sound output devices, the detector is further configured to detect a position and a direction of the user by monitoring the output reference sound using a microphone.

15. The electronic device of claim 11, wherein the processor is further configured to generate each of the plurality of pieces of sound information to include at least one piece of information from among volume information, a number of channels, and channel distribution information.

16. The electronic device of claim 15, wherein the number of channels of the plurality of pieces of sound information comprises n channels ($n>0$).

17. The electronic device of claim 11, wherein the processor is further configured to distribute each of the plurality of pieces of re-generated sound information to a corresponding sound output device from among the plurality of sound output devices.

18. A non-transitory computer-readable storage medium for storing a computer program of instructions configured to be readable by at least one processor for instructing the at least one processor to execute a computer process for performing the method of claim 1.

* * * * *